US008833406B2

(12) United States Patent
Berge et al.

(10) Patent No.: US 8,833,406 B2
(45) Date of Patent: Sep. 16, 2014

(54) METHOD AND APPARATUS FOR AN ICE CONVEYANCE SYSTEM

(75) Inventors: J. Eric Berge, Irvine, CA (US); Brandon Berge, Costa Mesa, CA (US); Mark McClure, Chino Hills, CA (US); Glenn Seamark, Lake Forest, CA (US)

(73) Assignee: Ice Link, LLC, Orange, CA (US)

( * ) Notice: Subject to any disclaimer, the term of this patent is extended or adjusted under 35 U.S.C. 154(b) by 504 days.

(21) Appl. No.: 13/317,078

(22) Filed: Oct. 7, 2011

(65) Prior Publication Data

US 2013/0087577 A1 Apr. 11, 2013

(51) Int. Cl.
*B65B 1/20* (2006.01)
*F25C 5/00* (2006.01)

(52) U.S. Cl.
CPC ..... *F25C 5/002* (2013.01)
USPC ..... 141/82; 141/95; 141/256; 141/275; 62/344

(58) Field of Classification Search
CPC ..... F25C 5/00; F25C 5/002
USPC ..... 141/82, 94, 95, 255, 256, 275–278; 222/146.6, 639; 62/344
See application file for complete search history.

(56) References Cited

U.S. PATENT DOCUMENTS

| | | | | |
|---|---|---|---|---|
| 4,189,063 | A * | 2/1980 | Matthiesen | 222/1 |
| 5,088,300 | A * | 2/1992 | Wessa | 62/340 |
| 5,299,427 | A * | 4/1994 | Miller et al. | 62/66 |
| 5,660,506 | A * | 8/1997 | Berge et al. | 406/3 |
| 6,571,573 | B1 * | 6/2003 | Henry | 62/344 |
| 6,932,124 | B2 * | 8/2005 | Dalton et al. | 141/82 |
| 7,421,834 | B1 * | 9/2008 | Doolan | 53/570 |
| 7,426,945 | B2 * | 9/2008 | Dalton et al. | 141/82 |
| 7,681,408 | B2 * | 3/2010 | Hobson et al. | 62/137 |
| 7,900,660 | B2 * | 3/2011 | Ladson | 141/82 |

* cited by examiner

*Primary Examiner* — Timothy L Maust
(74) *Attorney, Agent, or Firm* — Christopher L. Makay

(57) ABSTRACT

An ice supply system delivers a product to a product engagement device having at least one product engagement jaw, and a discharge tube. An engaged product is delivered at an outlet of the tube. The ice supply system includes a sensor disposed in communication with a product stream to detect the product at a sensor elevation, and communicate the presence of product to a controller. The ice supply system further includes a product receptacle for receiving the engaged product. The product receptacle may be mobile or have an elevation adjustment, thereby providing the ability to create a product pile of a predetermined height beneath the discharge tube. In this configuration, the controller ceases the flow of product when the pile height reaches the sensor disposed in the discharge tube. Alternatively, the ice supply system includes a diverter to toggle between first and second flowpaths, thereby delivering engaged and non-engaged product.

19 Claims, 13 Drawing Sheets

METHOD AND APPARATUS FOR AN ICE CONVEYANCE SYSTEM

BACKGROUND OF THE INVENTION

1. Field of the Invention

The present invention relates to product dispensing equipment and, more particularly, but not by way of limitation, to conveyance of a product to a product engagement device for use in dispensing and display equipment.

2. Description of the Related Art

Convenience and grocery stores currently utilize crushed ice in displays or beverage dispensers. Typically, the crushed ice is cubed ice that is processed on site to create the more desirable form for the display units, or to cater to an ice preference of consumers.

While the availability of the newly crushed ice at a product dispenser or a display unit is appealing, the process of creating the crushed ice is often unsanitary. Often, the cubed ice is dropped into a storage bin; manually removed from the storage bin by a laborer; the removed portion is then transported to a crusher by the laborer; the laborer then moves the portion into the crusher; the laborer then gathers the crushed ice; and transports to the newly formed crushed ice to a point-of-use, such as an display unit or a product dispenser for consumption with a drink extracted from the product dispenser.

The problem is further compounded by the shear volume of crushed ice required due to the increased melt rate of crushed ice particles, and the consumption of the crushed ice with beverages. As such, the crushed ice replenishment sequence must be repeated on a frequent basis, even several times a day.

Accordingly, a product conveyance system that transports ice to a point-of-use, crushes the ice, and automatically fills a display unit, a derivative thereof, or a product dispenser with a sanitary product, would be beneficial to consumers, retailers, ice producers, and product manufacturers. Still further, the ability to deliver both crushed ice and cubed ice to consumers in a controlled, sanitary fashion provides increased delivery options.

SUMMARY OF THE INVENTION

In accordance with a simplest embodiment of the present invention, an ice supply system delivers a product from a product generator through the use of an ice transport system. In this simplest embodiment, a product engagement device is connected to an outlet of the ice transport system for receiving ice. The product engagement device includes an inlet, and at least one product engagement jaw, and a discharge tube having an outlet. The product engagement jaw is coupled to a driver, and engages the product when the driver is powered. In this disclosure, engaging the product includes crushing, squeezing, crunching, fracturing, and the like, whereby an engaged product is delivered at the outlet of the discharge tube when the driver is powered by a controller. In this simplest embodiment, the ice supply system delivers the engaged product to a counter top in a store. The ice supply system still further includes at least one sensor disposed at the outlet to detect the presence of the product at a sensor elevation, and communicate the presence of product or lack of product to the controller.

In an extension of this simplest embodiment, the ice supply system further includes a product receptacle for receiving the engaged product. In this extension of the simplest embodiment, the product receptacle may be part of a store countertop, or may be a separate unit that includes an elevation adjustment, thereby providing the ability to create a pile of product at a predetermined height beneath the outlet of the discharge tube. In this configuration, the controller ceases the flow of product when the pile height reaches the at least one sensor disposed at an outlet of the discharge tube. In a second extension of the simplest embodiment, the product receptacle is mobile, whereby a person may move a filled product receptacle to a worksite within the store.

In a second embodiment, the ice supply system includes a diverter having one inlet and two outlets. A first flowpath is defined by the inlet and a first outlet, and a second flowpath is defined by the inlet and a second outlet, wherein the controller dictates whether the diverter is in position for the first flowpath or the second flowpath. In this second embodiment, a product engagement device is coupled to the first outlet, and a second discharge tube is coupled to the second outlet. Accordingly, the controller may shuffle between the first flowpath and the second flowpath to deliver either an engaged product or a non-engaged product for use. In this configuration, the product engagement device and the second discharge tube may include sensors to convey the presence of product at the sensor elevation. Accordingly, an auto-fill program may be initiated. In an extension of the second embodiment, a remote input may be utilized to allow users to generate a demand for product.

In a third embodiment, the ice supply system is utilized in combination with a product dispenser to deliver both an engaged product and a non-engaged product to the product dispenser.

In a fourth embodiment, the ice supply system operates in a slave mode, wherein the product dispenser monitors the levels of the product in bins, and conveys a demand to the ice supply system for replenishment.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

In a simplest embodiment, an ice supply system 100 includes an ice transport system 110, an ice generator 105 and a product engagement device 140. The ice transport system 110 described herein is similar in function to the ice transport systems disclosed in U.S. Pat. No. 6,266,945 entitled ICE SUPPLY SYSTEM, and U.S. Pat. No. 6,827,529 entitled VACUUM PNEUMATIC SYSTEM FOR THE CONVEYANCE OF ICE. The disclosures of which are hereby incorporated by reference.

Figure 1A:
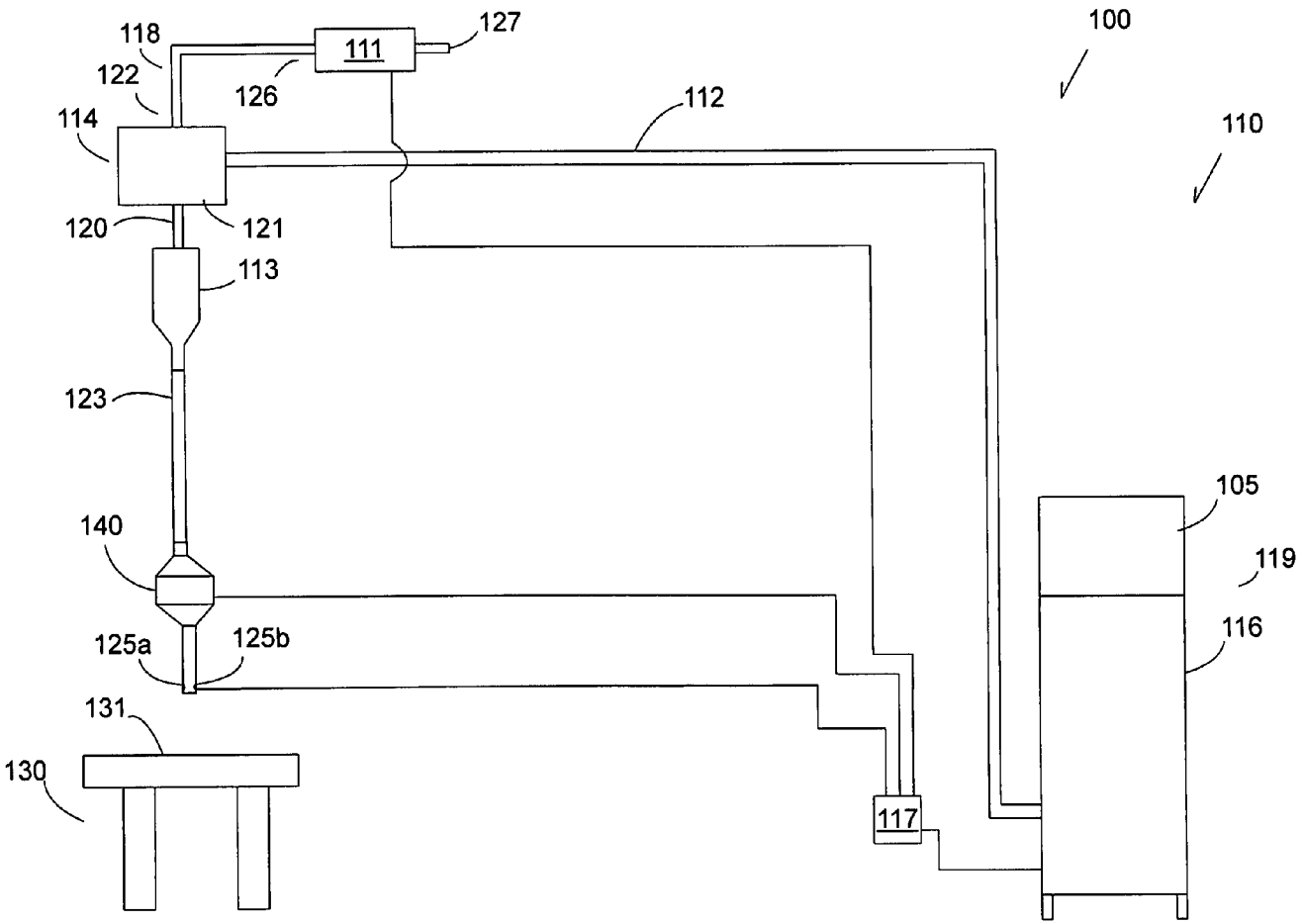
FIG. 1*a* provides a plan view of an ice supply system according to the preferred embodiment.
Figure 1C:
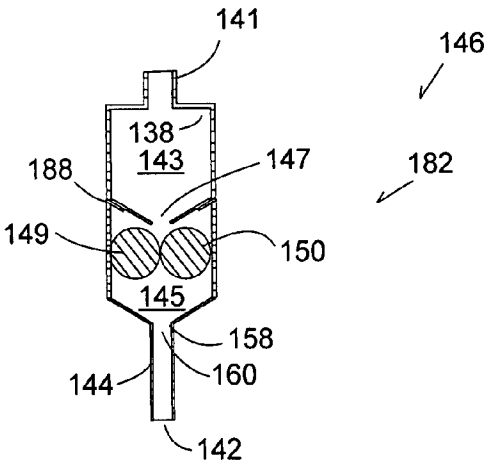
FIG. 1*c* provides a section view of the product engagement device according to the preferred embodiment.

As shown in FIG. 1*a*, the ice transport system 110 includes an ice dispenser 116, at least one ice transport tube 112, a separator 114, an airline 118, a blower 111, a controller 117, and an accumulator 113. As previously described in the disclosure of U.S. Pat. No. 6,872,529, the ice supply system further includes a product generator. As shown in FIG. 1*a*, a product generator 105 includes an outlet. In this particular example of the simplest embodiment, the product generator 105 is an ice maker having an outlet disposed at a lowest point to discharge ice downward. While the product generator 105 has been shown with an outlet at a lowest point, one of ordinary skill in the art will recognize that product generators with other outlet locations may be utilized, and should be construed as being within the scope of this invention.

The ice dispenser 116 includes a bin 119 having an inlet disposed adjacent to the outlet of the product generator 105, whereby the product generator 105 delivers product to the inlet of the bin 119. The ice dispenser 116 further includes an unbridger to break apart larger than desired product clumps. The ice dispenser 116 further includes a gated outlet for connection to the transport tube 112, whereby product is able to pass from the bin and through the outlet upon a proper gating sequence.

The transport tube 112 provides connection between the outlet of the ice dispenser 116 and an inlet of the separator 114. The separator 114 further includes an air outlet port 122 for connection to an inlet of the airline 118 and a product outlet port 121 for connection to an accumulator inlet conduit 120. The accumulator inlet conduit 120 further includes an outlet connectable to an inlet of the accumulator 113. The accumulator 113 includes a reservoir for receiving a predetermined quantity of product, and an outlet port for delivering the product disposed within the reservoir to an accumulator outlet conduit 123.

The product engagement device 140 includes an upper housing 146, a first engagement jaw 149, a second engagement jaw 150, a driver 151, and a discharge tube 144. The upper housing 146 may be formed from any structural material. In this simplest embodiment, the upper housing 146 is formed from stainless steel sheet-metal for corrosion resistance. While the housing has been shown to be formed from stainless steel, one of ordinary skill in the art will recognize that other materials may possibly be utilized. The upper housing 146 includes a lid 175 having an inlet flange 141 in communication with a receiving chamber 143. The receiving chamber 143 is of a volume sufficient to receive a predetermined quantity of the product collected in the reservoir of the accumulator 113. The receiving chamber 143 further includes an outlet 147. The outlet 147 is tapered downward and is of a predetermined size to surround the first and second engagement jaws 149-150, thereby directing the product disposed within the receiving chamber 143 through the outlet 147 and to the first and second engagement jaws 149-150.

Figure 1D:
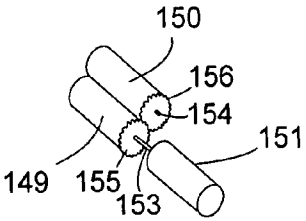
FIG. 1*d* provides an isometric view of the driver according to the preferred embodiment.

The first engagement jaw 149 is a cylindrically shaped drum having at least one engagement tooth. The second engagement jaw 150 is includes teeth that are symmetrically disposed. Accordingly, at a predetermined spacing, the first and second engagement jaws 149-150 may be counter rotated to produce a crushing effect on the product passing through the outlet 147 and between the first and second engagement jaws 149-150. In this simplest embodiment, the first engagement jaw 149 includes a shaft 153, and a drive gear 155 disposed on the shaft 153. In similar fashion, the second engagement jaw 150 includes a shaft 154, and a drive gear 156 disposed on the shaft 154. As shown in FIG. 1*d*, the drive gears 155 and 156 are timed complementarily, and, accordingly, rotation of the shaft 153 will cause both of the engagement jaws 149-150 to counter-rotate. The first and second engagement jaws 149-150 are secured in a lower housing 182 directly beneath the outlet 147, such that they are able to rotate. Illustratively, a bearing may be utilized at the point of passage through an exterior wall of the lower housing 182.

The driver 151 is a torque creation device. In this particular example, the driver 151 is an electric motor that adapts to the shaft 153 of the first engagement jaw 149. The driver 151 may be secured to the shaft 153 utilizing any suitable means known in the art, such as pins, splines, and the like. While this product engagement device 140 is disclosed with the driver 151 being an electric motor, one of ordinary skill in the art will recognize that virtually any form of torque generator may be utilized, and therefore, should be construed as being within the scope of this invention.

The lower housing 182 is constructed from first through fourth walls 183-186 that forms a discharge chamber 145 disposed directly beneath the first and second engagement jaws 149-150 and the receiving chamber outlet 147, such that product passing through the first and second engagement jaws 149-150 enters the discharge chamber 145. The discharge chamber 145 includes tapered walls, whereby the crushed product moves to a discharge chamber outlet 158. The discharge tube 144 includes a discharge tube inlet 160 and a discharge tube outlet 142. In this simplest embodiment, the discharge tube inlet 160 is connected to the discharge chamber outlet 158 and the discharge tube outlet 142 is open for delivery.

Figure 1B:
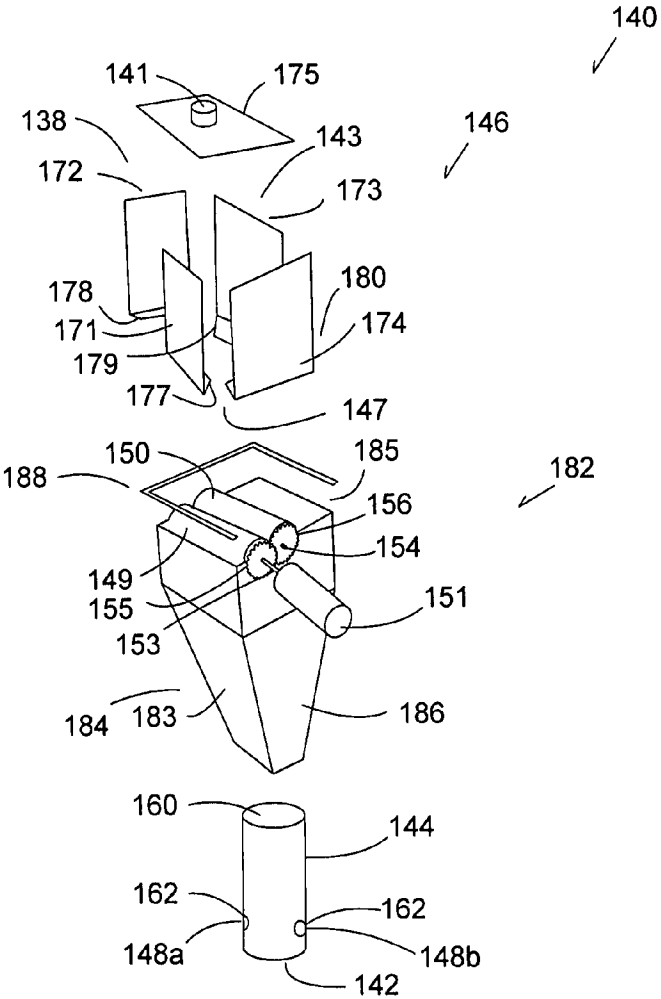
FIG. 1*b* provides an exploded view of a product engagement device according to the preferred embodiment.

The product engagement device 140 further includes a sensor pair disposed in proximity to the discharge tube outlet 142. As shown in FIG. 1*b*, a sensor 148*a* and a sensor 148*b* are disposed opposing each other to monitor the presence of product between the sensor pair 148*a*-148*b*. In this particular example, sensor 148*a* is an emitter and sensor 148*b* is a detector. While this sensor pair has been shown with an emitter and a detector, one of ordinary skill in the art will recognize that other forms of sensors are possible, and may be utilized, and, therefore, should be construed as being within the scope of this invention.

The controller 117 is defined as virtually any form of processing device, that is able to conduct subroutines, control electronic devices, control torque generating devices, communicate with the other processors and control systems, and the like. In this simplest embodiment, the controller 117 is in electrical communication with the ice dispenser 116, the blower 111, product engagement device 140, and the sensors 148*a*-148*b*.

The airline 118 is formed from materials compatible with the transport tube 112, and the blower 111. The airline 118 provides a path from the air separator port 122 of the separator 114 to an inlet 126 of the blower 111. In this simplest embodiment, the blower 111 is of a same construction as described in the referenced patent application, whereby the blower 111 moves air through from the inlet 126 to an outlet 127, thereby creating a lower pressure in the airline 118 and the transport tube 112, when the blower 111 is powered.

Figure 2B:
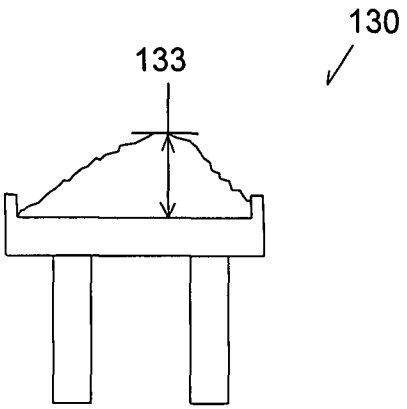
FIG. 2*b* provides a plan view of the product receptacle containing a pile of a predetermined height according to the preferred embodiment.
Figure 2A:
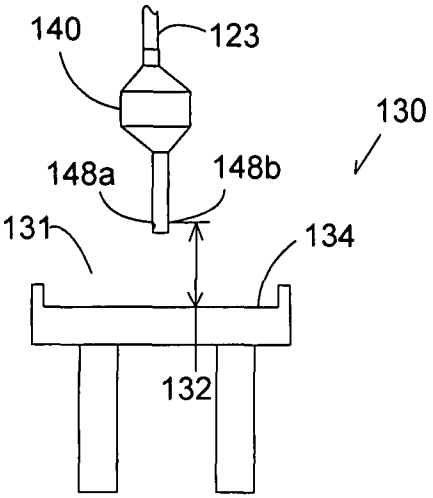
FIG. 2*a* provides a plan view of a product receptacle according to the preferred embodiment.

The ice supply system 100 further includes a product receptacle 130 for receiving the product that has been crushed. As shown in FIGS. 1*a* and 2*a*, the product receptacle 130 includes a basin 131 having a floor 134 disposed at a predetermined distance 132 from the sensors 148*a* and 148*b*. In this particular example of the simplest embodiment, the basin 131 may be a counter top in a store. Illustratively, the distance 132 between the floor 134 and the sensors 148*a*-148*b* is equivalent to a pile height 133 of the product being conveyed, thereby delivering a desired quantity of product, as shown in FIG. 2*b*. While this particular example has been shown with a floor 134 disposed at a predetermined distance, one of ordinary skill in the art will recognize that virtually any distance between the floor 134 and the sensors 148*a*-148*b* may be utilized to effect delivery of a desired predetermined amount of product to the basin 131. The basin 131 may further include walls to aid in containment of the product during delivery and use.

The ice transport system 110 up to the accumulator 113 is assembled in similar fashion to the referenced patents to provide an open conduit path from the bin 119 in the ice dispenser 116, through the transport tube 112, and to the separator 114. The separator 114 is oriented such that the air outlet port 122 is disposed upward, and the product outlet port 121 is disposed downward, thereby allowing gravitational forces to act on the product particles entering the separator 114. The airline 118 is secured to the air outlet port 122 and the blower 111 using any suitable means known in the industry to create a substantially airtight passage, such as solvent bonds on plastic piping, mechanical connections including gaskets and fasteners, and the like.

Assembly of the accumulator 113 is as described in the referenced patent, and provides for an accumulator inlet conduit 120 in fluid communication with the inlet of the accumulator 113, a reservoir disposed within the accumulator 113, a flapper valve disposed at an outlet of the reservoir, and the accumulator outlet conduit 123 extending from the outlet of the reservoir. On assembly, the joints of the accumulator may be bonded together to create a single piece accumulator housing assembly having a flapper that rotates within the angular range available within the accumulator housing. Once the accumulator 113 is assembled, the inlet port of the accumulator inlet conduit 120 may be secured to the product outlet port 121 of the separator 114, such that the accumulator 113 is disposed below the separator 114. In this fashion, the accumulator 113 is able to receive the product particles that are acted upon by the gravitational forces, thereby falling into the reservoir of the accumulator 113.

Assembly of the product engagement device 140 commences with the formation of the housing 146. In particular, the first through fourth walls 171-174 are formed with a first through fourth flanges 177-180, respectively, and are secured to each other utilizing any suitable means, such as welding, or fasteners in aligned holes. The first through fourth flanges 177-180 are directed toward each other to create outlet 147 in a lower end of the housing 146. Once welded, the receiving chamber 143 includes an inlet 138 at the upper end and the outlet 147 at the lower end. The inlet 138 is of a size complementary to the lid 175, such that the lid 175 closes out the inlet 138. The lid 175 may be welded in place to create a receiving chamber 143 that is not open to the environment. The inlet flange 141 may then be welded to the lid 175, thereby creating a sealed receiving chamber 143. Alternatively, the lid 175 may be restrained through a mechanical means, such as clamps in combination with a gasket, to allow disassembly and cleansing.

Assembly of the lower housing 182 commences with the forming of the first through fourth walls 183-186 to create a discharge chamber 145 tapered in form leading to the discharge chamber outlet 158. In this particular example, the first through fourth walls 183-186 are formed contiguously, and then a single seam is welded together. Upon the completion of the welding, the first engagement jaw 149 is placed onto the shaft 153, and assembly is then inserted into shaft apertures disposed in the lower housing 182, whereby the exposed shaft 153 extends through the fourth wall 186. One of ordinary skill in the art will recognize that a bearing may be utilized to reduce friction during rotation. Next, the drive gear 155 is installed onto shaft 153. In identical fashion, the second engagement jaw 150 is secured onto the shaft 154, and the assembly is placed through the shaft apertures such that the second and first engagement jaws 149 and 150 are disposed parallel to each other, at a predetermined distance from each other, and are able to rotate. Next, the drive gear 156 is placed onto the shaft 154 in alignment with, and in time with the drive gear 155, whereby the drive gears 155 and 156 mesh with each other, and rotate when one of the shafts is turned. Next, the driver 151 is secured to the shaft 153 to drive the shaft 153 when the driver 151 is powered.

On continued assembly, the discharge tube inlet 160 is mated to the discharge chamber outlet 158, and is welded in place, thereby forcing the product that is crushed to exit the discharge tube outlet 142. The assembly continues with the insertion of the sensors 148*a*-148*b* into the sensor apertures 162 disposed in the discharge tube 144. While the sensor apertures 162 have been shown to be near the discharge tube outlet 142, one of ordinary skill in the art will recognize that the sensor apertures 162 may be disposed at virtually any elevation by lengthening or shortening the discharge tube 144, dependent upon the requirements of the ice supply system 100.

On final assembly, the lower housing 182 is mated to the upper housing 146, thereby registering the first and second engagement jaws 149-150 directly beneath the outlet 147 to capture any product entering the receiving chamber 143. In this particular example, the lower housing 182 is welded and sealed to provide a watertight device. However, one of ordinary skill in the art will recognize that the upper and lower housings 146 and 182 may be mechanically fastened together and sealed with a sealing member 188. In this particular example, the sealing member 188 is a compression gasket. In this configuration, the upper and lower housings 146 and 182 may be separated from each other for disassembly and cleansing. Alternatively, a cleansing routine of the product dispenser 116 may deliver slurry of product treated with at least one cleansing agent to the product engagement device 140 to cleanse the interior components.

The buildup of the ice supply system 100 further requires connection of the product engagement device 140 to the accumulator outlet conduit 123. Upon the mating of the inlet flange 141 to the outlet of the accumulator outlet conduit 123, the mechanical portion is fully assembled. The ice supply system 100 further requires electrical connection of the controller 117 to the sensors 148*a*-148*b*, the driver 151 of the product engagement device 140, the blower 111, and the ice dispenser 116.

In this disclosure, the term "pulse" is defined as a predetermined duration of product being transported from the ice dispenser 116 to the separator 114 by vacuum forces. It is desirable to have a "pulse" length that is less than or equivalent to the volume of the reservoir disposed within the accumulator 113, thereby allowing a dropping of the product disposed within the reservoir when the "pulse" ends. Alternatively, multiple pulses may be utilized to fill the reservoir.

In use, the controller 117 recognizes a demand generated at the ice dispenser 116 and the ice supply system 100 delivers product from the bin 119 disposed within the ice dispenser 116 by activating the blower 111 to create a lower pressure in the airline 118, the separator 114, the accumulator 113, and transport tube 112, opening a gate valve at the inlet port of the transport tube 112 to expose the inlet port of the transport tube 112 to the vacuum, moving the product particles through the transport tube 112 to the separator 114 where they are acted upon by gravitational forces and fall downward into the reservoir of the accumulator 113.

Once a predetermined pulse or series of pulses has been delivered to the reservoir of the accumulator 113, the controller 117 activates the product engagement device 140 by powering the driver 151, thereby commencing rotation of the driver 151 connected to the shaft 153. The rotation of the shaft 153 causes the rotation of the engaged gears 155 and 156, thereby causing timed counter rotation of the shafts 153 and 154, as well as the first and second engagement jaws 149-150. Next, the controller 117 ceases the delivery of power to the blower 111, thereby allowing the pressure in the conduit to equalize to allow the gravitational forces of the product disposed within the reservoir to over power the flapper retention forces. At this point, the flapper opens partially, thereby allowing the product to fall into the receiving chamber 143 of the product engagement device 140, and through the outlet 147 to be acted upon by the first and second engagement jaws 149-150. In this invention, the first and second engagement jaws 149-150 crush the ice cubes or ice cube segments as they move between the first and second engagement jaws 149-150. As such, crushed product particles enter the discharge chamber 145 and move through the discharge tube 144 to exit the outlet 142.

Upon exiting the discharge tube outlet 142, the newly crushed particles land in a pile on the floor 134 of the product receptacle 130. The pile continues to grow until the crushed product breaks the beam emitted from sensor 148*a*, thereby indicating that the desired amount of crushed product has been delivered. Once the beam is broken, the demand is relieved from the system.

Figure 2C:
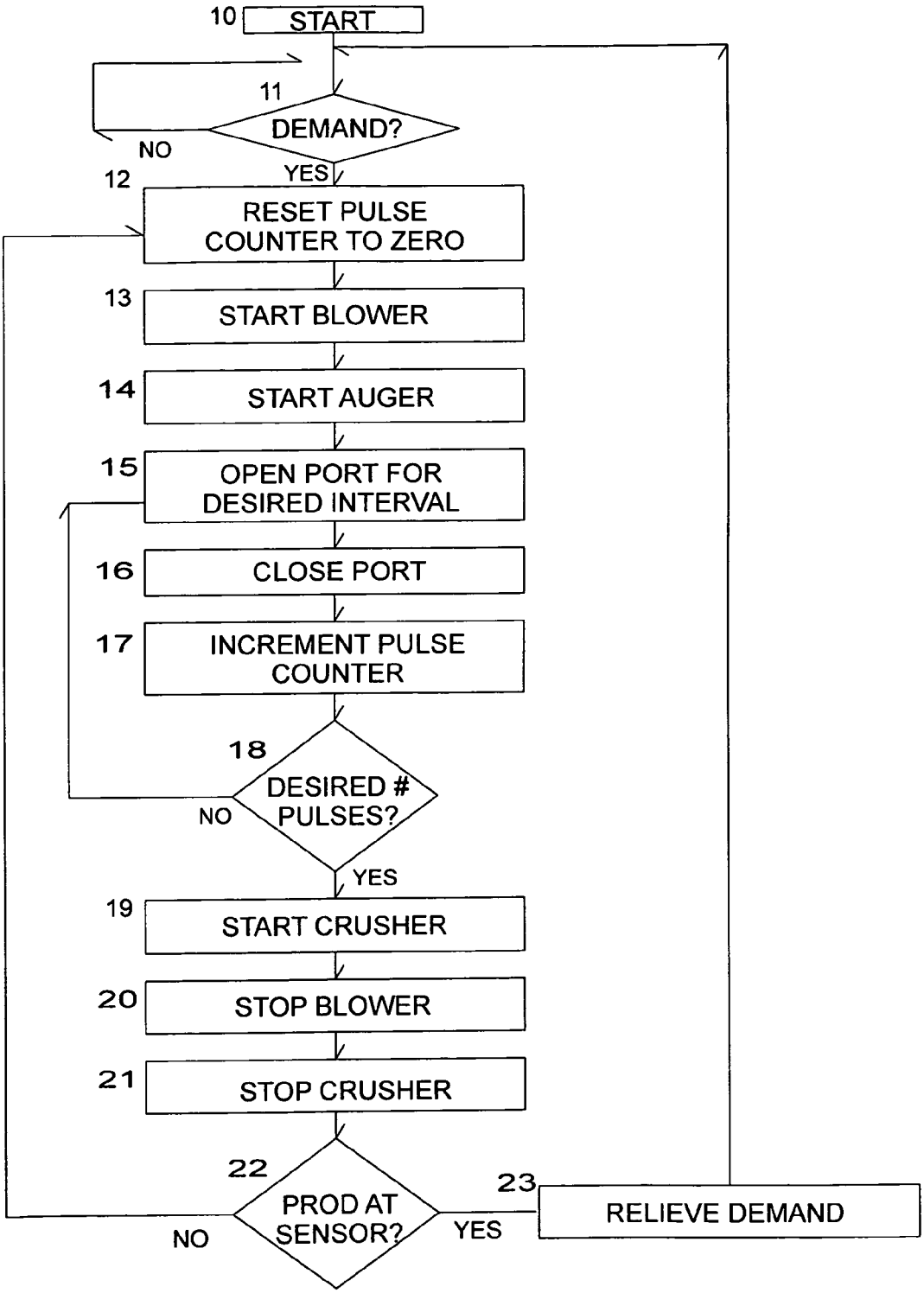
FIG. 2*c* is a flowchart illustrating the method steps for delivering a product pile to the product receptacle according to the preferred embodiment.

As shown in the method flowchart of FIG. 2*c*, the process commences with step 10, and moves to step 11, wherein the controller 117 determines if a demand exists. If a demand does not exist in step 11, the controller returns to step 11 to recheck demand. If a demand does exist in step 11, the controller 117 moves to step 12, and resets a pulse count to zero. In step 13, the controller 117 powers the blower 111, and in step 14, the controller 117 delivers power to the auger motor, thereby breaking the large clumps of product. The controller 117 then opens the port for a desired path and interval, step 15. In step 16, the controller 117 closes the port, and in step 17 the controller 117 increments the pulse count by one. The controller 117 then moves to step 18, wherein the controller 117 determines if the desired pulse count has been reached. If the desired pulse count has not been reached, then the controller 117 returns to step 15 to send additional product. If a desired pulse count has been reached in step 18, the controller 117 commences the delivery of power to the product engagement device 140, step 19. In step 20, the controller 117 stops the delivery of power to the blower 111 to allow the pressure in the transport tube 112 to equalize. The controller 117 then ceases the delivery of power to product engagement device 140, step 21. In step 22, the controller 117 determines if the sensor beam has been broken. If the sensor beam has not been broken, the controller 117 returns to step 12 to reset the counter to zero. If product has broken the sensor beam in step 22, the controller 117 moves to step 23 to relieve the demand, and returns to step 11.

Figure 3:
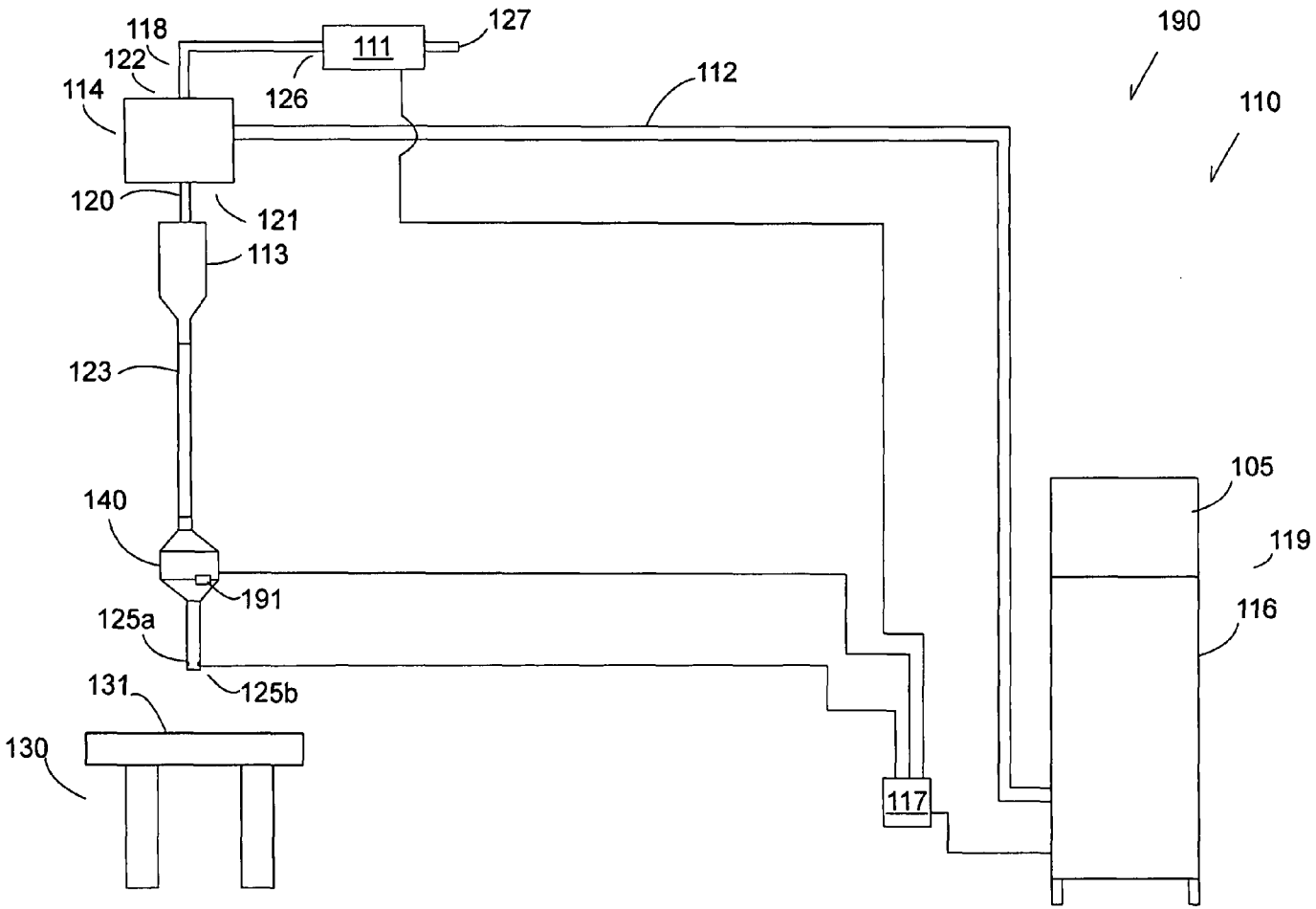
FIG. 3 provides a plan view of an ice supply system according to an extension of the preferred embodiment.

In an extension of the simplest embodiment, an ice supply system 190 includes a remote input apparatus 191 that is disposed in proximity to the product engagement device 140. As shown in FIG. 3, in this particular extension of the simplest embodiment, the remote input apparatus 191 is a button in electrical communication with the controller 117, whereby an operator pushes the button to initiate a demand at the controller 117. In this disclosure, the term "demand" is defined as a need for product at the product engagement device 140. The "demand" may be generated at the ice supply system 116 or at the remote input apparatus 191 of the product engagement device 140. Use of this particular example is substantially identical to the method flowchart of FIG. 2*c*, whereby the controller 117 checks for demand in step 12.

Figure 4B:
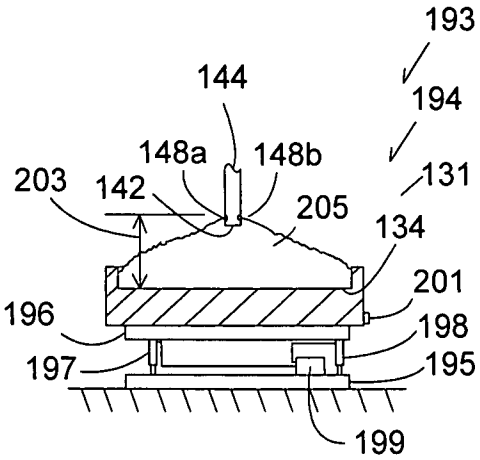
FIGS. 4*a* and 4*b* provide a plan view of a product receptacle having an elevation adjustment capability according to a second extension of the preferred embodiment.
Figure 4A:
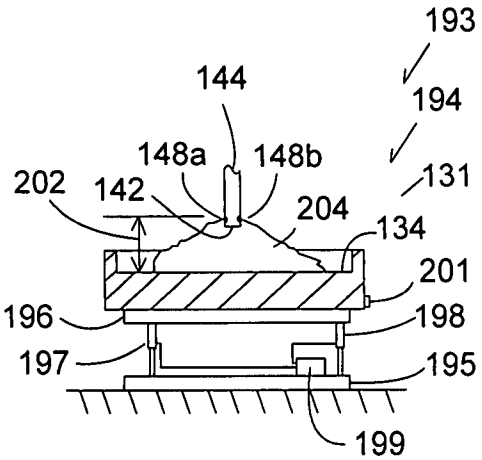

In a second extension of the simplest embodiment, an ice supply system 193 includes a product receptacle 194 having an elevation adjustment capability. As shown in FIGS. 4*a*-4*b*, the product receptacle 194 includes a basin 131 having a floor 134 in similar fashion the product receptacle 140 of the ice supply system 100. However, the product receptacle 194 includes a lower frame 195, an upper frame 196, and a first and second extension members 197-198. A first end of the extension members 197-198 is attached to the lower frame 195, and a second end is attached to the upper frame 196. The product receptacle 194 further includes a pressure source 199 and a control module 201 that raises or lowers the pressure of the extension members 197-198, thereby adjusting the elevation of the floor 134 with respect to the discharge tube outlet 142 and the sensors 148*a*-148*b*. In this particular example, the first and second extension members 197-198 are pneumatic cylinders. While this particular example has been shown with extension members made from pneumatic cylinders, one of ordinary skill in the art will recognize that virtually any form of extension device may be utilized to raise and lower the product receptacle 194, and, therefore, should be construed as being part of this invention.

In use, the product receptacle 194 may positioned beneath the outlet 142 of the discharge tube 144, such that product exiting the discharge tube 144 falls onto the floor 134 of the basin 131. At that point, an operator may hit the control module 201 to extend or retract the first and second extension members 197-198. In an uppermost position, as shown in FIG. 4*a*, the floor 134 of the basin 131 is disposed a distance 202 from the sensors 148*a* and 148*b*, thereby generating a small pile 204. In contrast, a lowermost position places the floor 134 a distance 203 from the sensor pair 148*a* and 148*b*, thereby generating a larger pile 205, FIG. 4*b*. Once position properly, the operator may place a demand on the ice dispenser 116 to commence the creation of crushed product, as shown in FIG. 2*c*.

In a second extension of the simplest embodiment, an ice supply system 210 includes a mobile product receptacle 211. As shown in FIG. 5*a*, the mobile product receptacle 211 includes a basin 131 having a floor 134 in similar fashion to the previous embodiments. The mobile product receptacle 211 further includes a frame 213, and wheels 214 secured to the frame 213, such that the mobile product receptacle 211 may be moved from the filling location to an alternate work site. In this particular example, the frame 213 is formed from tubular extrusions that are welded together for rigidity and bearing strength, and the wheels 214 include rigid hubs covered with polymeric tires for strength. In this particular example, the wheels 214 are rotatable.

On assembly, the frame 213 may be welded together first. Next, the wheels 214 may be inserted into the lower portions of the frame 213. Last, the basin 131 may be attached to the frame 213 utilizing know connection methods, such as fasteners.

Figure 5B:
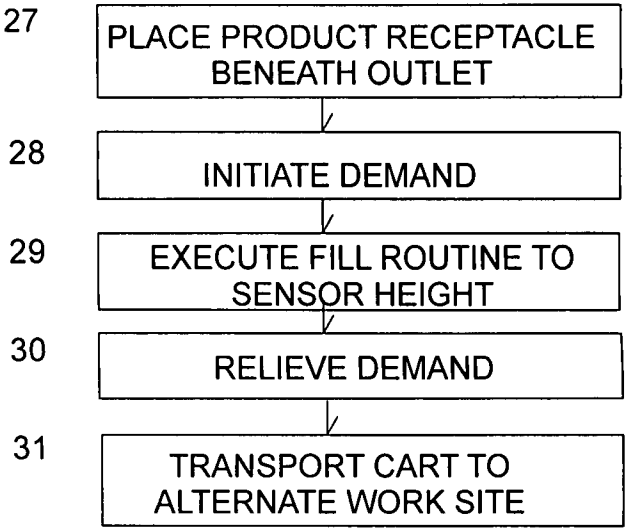
FIG. 5*b* provides a method flowchart for utilizing the mobile product receptacle according to the second extension of the preferred embodiment.
Figure 5A:
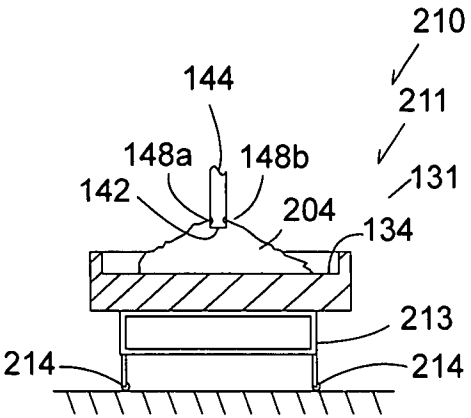
FIG. 5*a* provides a plan view of product receptacle that is mobile according to a second extension of the preferred embodiment.

In use, as shown in the method flowchart of FIG. 5*b*, an operator moves the mobile product receptacle 211 beneath the outlet 141 of the ice supply system 210, step 27, and initiates a demand, step 28. Next the controller 117 fills the demand, thereby delivering crushed product to the point that the sensors 148*a* and 148*b* indicate that the product has reached the level of the sensors 148*a*-148*b*, step 29. In step 30, the controller 117 relieves the demand. Step 31 provides for the operator transporting the mobile product receptacle 211 to an alternate work site for use of the crushed product.

In this disclosure, the term combination product receptacle is defined as a product receptacle that includes both elevation adjustment features and mobility features. While the first and second extensions of the simplest embodiment have been shown as being separate features, one of ordinary skill in the art will recognize that a combination product receptacle is certainly possible, and, therefore, should be construed as being within the scope of this invention.

Figure 6A:
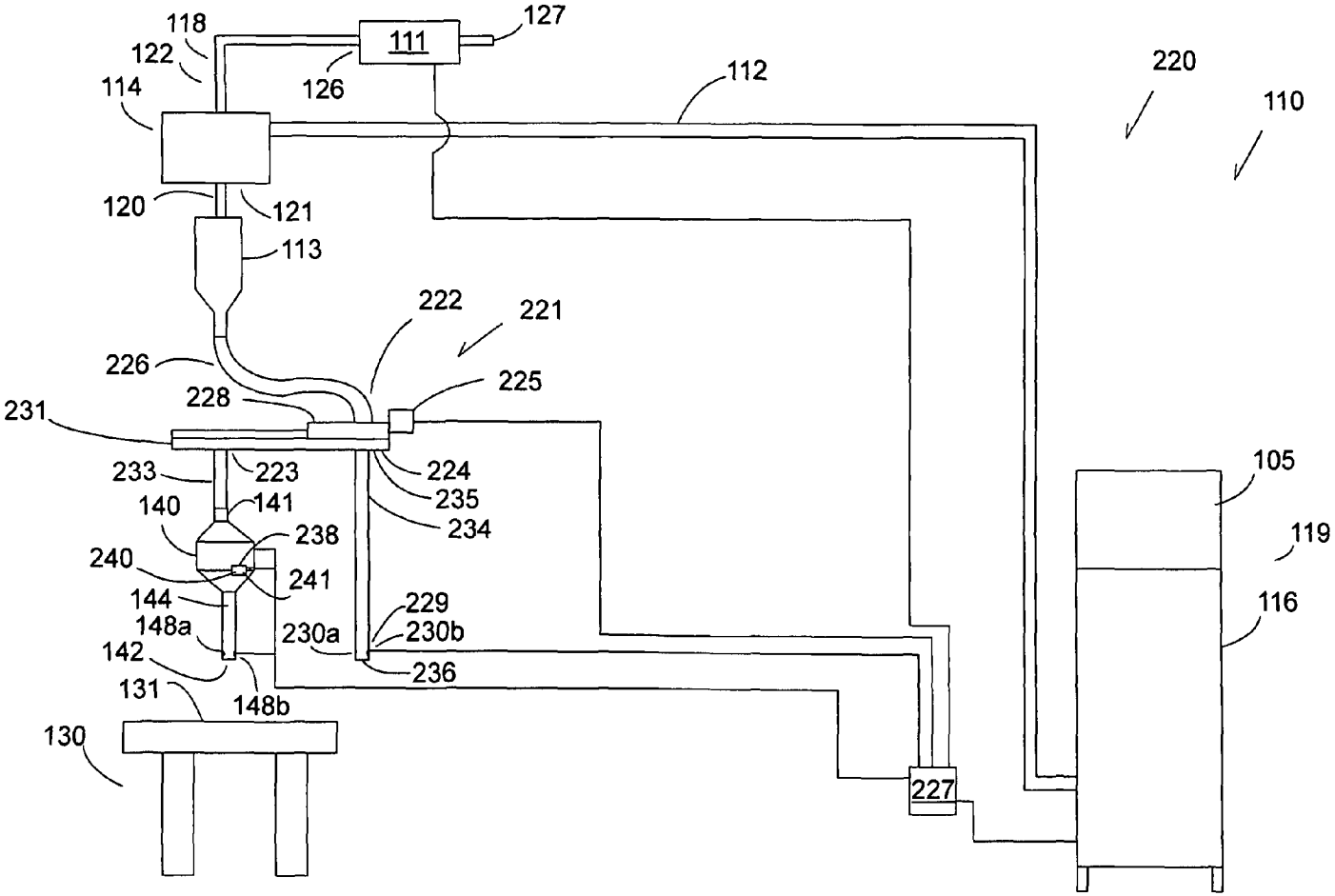
FIG. 6*a* provides a plan view of an ice supply system according to a second embodiment.

In a second embodiment, an ice supply system 220 is similar to the ice supply system 100, and therefore, like items have been referenced with like numerals; however, the ice supply system 220 further includes a diverter 221 disposed between the accumulator 113 and the product engagement device 140. As shown in FIG. 6*a*, the diverter 221 includes an inlet port 222 disposed on a sliding plate 228. The diverter 221 further includes a stationary plate 231 having a primary path outlet 223 and a secondary path outlet 224. The diverter 221 still further includes an actuator 225 in electrical communication with the controller 227, whereby the controller 227 is able to energize and de-energize the actuator 225 to move the sliding plate 228 from a first position to a second position, thereby connecting the diverter inlet 222 to either the primary path outlet 223 or the secondary path outlet 224.

While this embodiment has been shown with a sliding plate actuated by a controller, one of ordinary skill in the art will recognize that virtually any form of diverter may be utilized to control the delivery of product to multiple product paths.

The ice supply system 220 further includes a flexible conduit 226 disposed between the outlet of the accumulator 113 and the diverter inlet 222. The flexible conduit 226 allows movement of the sliding plate 228 from the first position to the second position without damage to piping. The flexible conduit 226 may be formed from food-grade material, if required. The ice supply system 220 still further includes a remote input 238 disposed near the product engagement device 140, whereby an operator may actuate the remote input 238. In this particular embodiment, the remote input 238 includes a first input 240 and a second input 241, and is in electrical communication with the controller 227.

The primary path outlet 223 is connected to a primary path conduit 233 that is connected to the inlet flange 141 of the product engagement device 140. The product engagement device 140 is substantially identical to the product engagement device 140 of first embodiment, and includes sensor pair 148*a* and 148*b* disposed at neat the outlet 142 of the discharge tube 144.

The secondary path outlet 224 is connected to an inlet 235 of the secondary path conduit 234. The secondary path conduit 234 is oriented parallel to the discharge tube 144, and includes an outlet 236 that is possibly, at a same elevation as the outlet 142. The secondary path conduit 234 also includes sensor apertures 229 in similar fashion to the discharge tube 144 for receiving sensors 230*a* and 230*b*. The sensors 230*a* and 230*b* are in electrical communication with the controller 227, and are the trigger point for determining if an adequate portion of product has been delivered through the secondary path conduit 234.

On assembly, a first end of the flexible conduit 226 is connected to the outlet of the accumulator 113, and a second end of the flexible conduit 226 is connected to the diverter inlet 222. Once in place, the inlet flange 141 of the product engagement device 140 is connected to the primary path outlet 223, thereby creating a primary path. The inlet of the secondary path conduit 234 is then attached to the secondary path outlet 224, thereby creating a secondary path. Once the mechanical components are connected, the remote input 238, the product engagement device 140, the actuator 225 of the diverter 221 and the sensors 148*a*-148*b*, and the secondary sensors 230*a*-230*b* may be electrically connected to the controller 227.

At this point, product moving from the product dispenser 116 may be delivered through either the primary path and the product engagement device 140 or through the secondary path. In this particular example of this second embodiment, the primary path requires the sliding plate 228 to be in the first position, whereby the diverter inlet 222 is aligned with the primary path outlet 223, and the product passes through the primary path conduit 233 en route to the product engagement device 140 and is crushed before exiting through the discharge tube 144.

In the case of the sliding plate 228 being in the second position, the diverter inlet 222 is aligned with the secondary path outlet 224, thereby forcing the product to pass through the secondary path conduit 234 in non-engaged or uncrushed form. Accordingly, the controller 227 dictates the position of the sliding plate 228 in the diverter 221, dependent upon the input provided by the operator at the remote input 238.

Figure 6B:
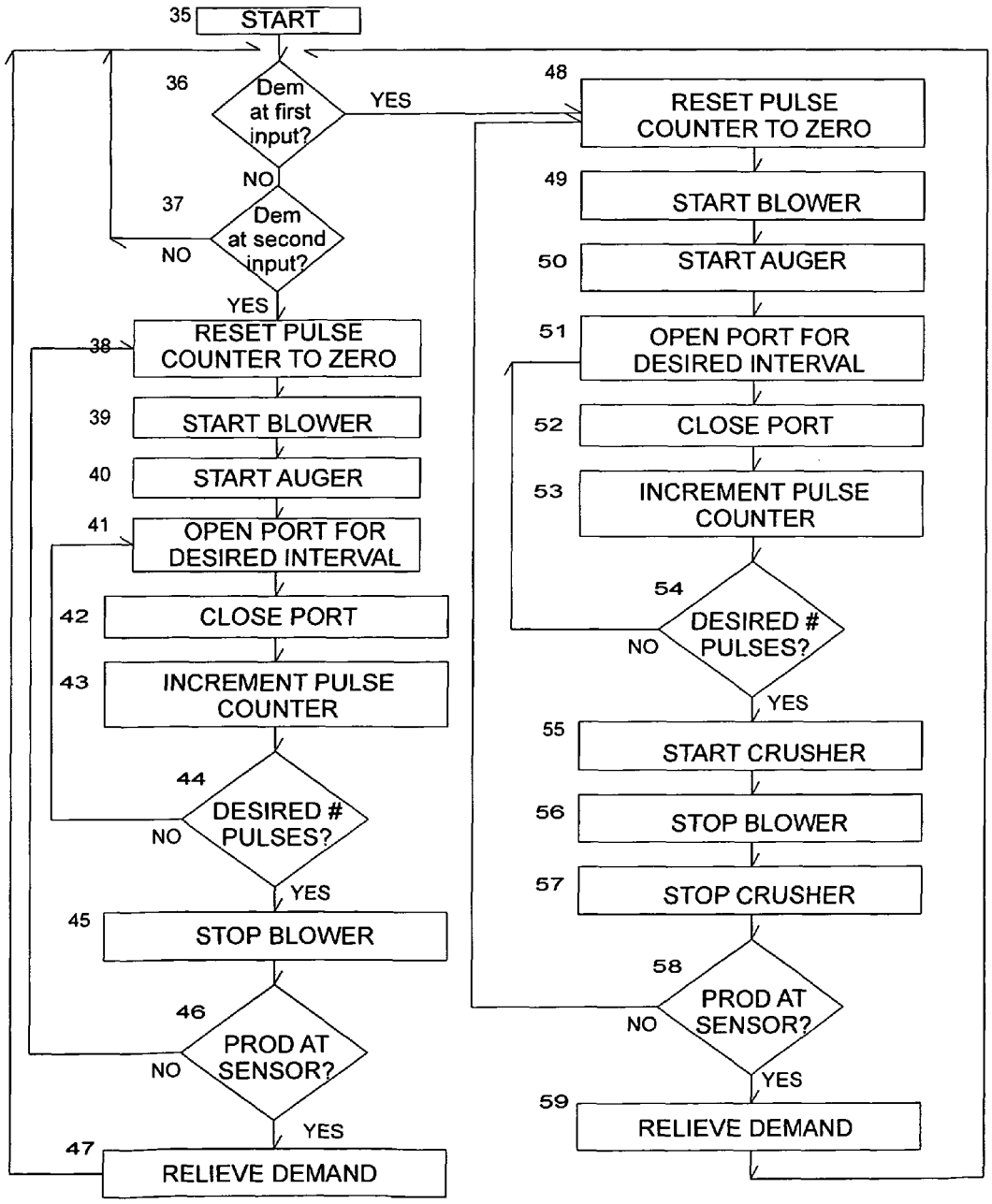
FIG. 6*b* provides a method flowchart for utilizing the ice supply system according to the second embodiment.

As shown in the method flowchart of FIG. 6*b*, the ice supply system 220 commences with step 36, wherein the controller 227 determines if a demand exists at the first input 240 of the remote input 238. If a demand does exist in step 36, the controller 227 moves to step 48, wherein the controller 227 resets the pulse counter to zero. The controller 227 then moves to step 49 to start the blower 111, and then the controller 227 moves to step 50 to start the auger. Next, in step 51, the controller 227 opens the desired port for a predetermined duration. In step 52, the controller 227 closes the port. In step 53, the controller 227 increments the pulse counter by 1. In step 54, the controller 227 determines if a desired number of pulses has been delivered. In a desired number of pulses has not been delivered in step 54, the controller 227 returns to step 51 to deliver additional pulse. If a desired number of pulses have been achieved in step 54, the controller 227 moves to step 55 and starts the product engagement device 140. Next, step 56, the controller 227 stops the blower 111. The controller 227 then moves to step 57, wherein the controller 227 stops the product engagement device 140. The controller 227 then determines if the delivered product level has reached the sensors 148*a*-148*b*, step 58. If the level of product delivered has broken the emitter beam in step 58, the controller 227 moves to step 59, relieves the demand, and then returns to step 36. If the controller 227 determines that the sensor beam has not been broken at the sensors 148*a*-148*b* in step 58, the controller 227 returns to step 48.

If a demand does not exist in step 36, the controller 227 moves to step 37 to determine if a demand exists at the second input 241 of the remote input 238. If a demand does not exist in step 37, the controller 227 returns to step 36 to restart the process. If a demand does exist in step 37, the controller 227 moves to step 38, wherein the controller 227 resets the pulse counter to zero. In step 39, the controller 227 starts the blower 111. The controller 227 moves to step 40 to start the auger, and then to step 41, wherein the controller 227 opens the desired port. Next the controller 227 moves to step 42 to close the port. In step 43, the controller 227 increments the pulse counter by one. In step 44, the controller 227 must determine if a desired number of pulses have been delivered. If the desired number of pulses have not been delivered in step 44, the controller 227 returns to step 41. If the desired number of pulses have been met in step 44, the controller 227 moves to step 45 to stop the blower 111. In step 46, the controller 227 determines if product has broken the sensor beam at the sensors 230*a*-*b*. If the product level has reached the sensors 230*a*-*b*, the controller 227 returns to step 41. If the product level has reached the sensors 230*a*-*b* in step 46, the controller 227 moves to step 47, wherein the controller 227 relieves the demand, and then the controller 227 returns to step 36.

Accordingly, the ice supply system 220 may deliver crushed product utilizing the sliding plate 228 of the diverter in the first position, or the ice supply system 220 may deliver non-engaged product or uncrushed product utilizing the sliding plate 228 in the second position. One of ordinary skill in the art will recognize that any type of product receptacle may be utilized to capture the product delivered from the ice supply system 220, and, therefore, fall within the scope of this invention.

Figure 7A:
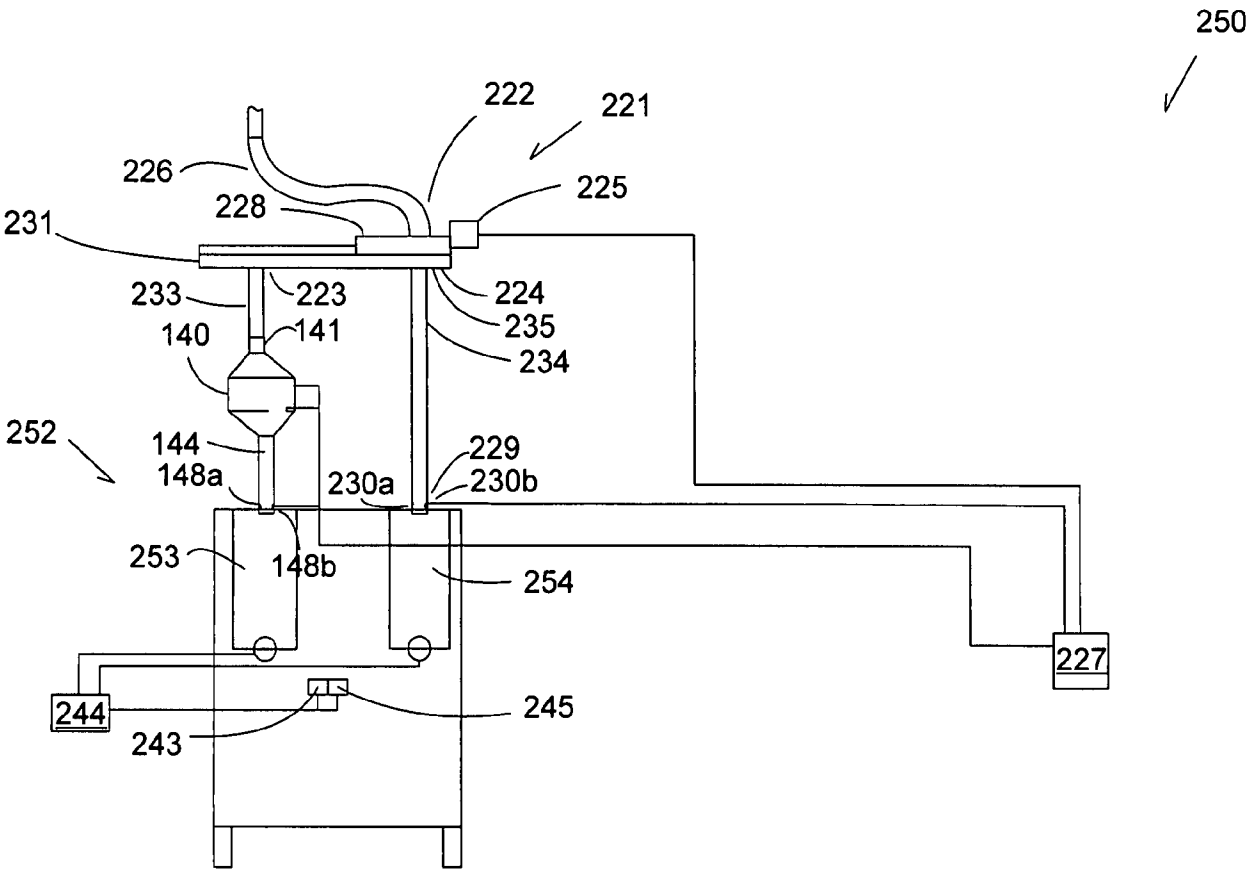
FIG. 7*a* provides a plan view of an ice supply system according to an extension of the second embodiment.

In an extension of the ice supply system 220, an ice supply system 250 delivers ice to a beverage dispenser 252 in both crushed and uncrushed form. In this particular extension of the ice supply system 220, like parts have been referenced with like numerals. As shown in FIG. 7*a*, the beverage dispenser 252 includes a first ice bin 253, a second ice bin 254, a beverage dispenser controller 244, and first and second inputs 243 and 245 disposed on a front of the beverage dispenser 252 for easy access by beverage dispenser operators. In this particular example, the first input 243 is assigned to actuate dispensing of the first bin 253 and the second input 245 is assigned to actuate dispensing of the product disposed within the second bin 254. As such, a user may select the first input 243 to initiate a demand for product from the first bin 253 or may select the second input 245 to input a demand for the product in the second bin 254.

In the current configuration, the ice supply system 250 may keep the first and second bins 253-254 filled by shuttling between the first position and the second position of the diverter 221. The beverage dispenser 252 does not control the fill levels of the first and second bins 253-254, just the dispensing of the products disposed within the bins 253-254. As such, an operator may get crushed ice, uncrushed ice, and a beverage from the front the beverage dispenser 252.

Figure 7B:
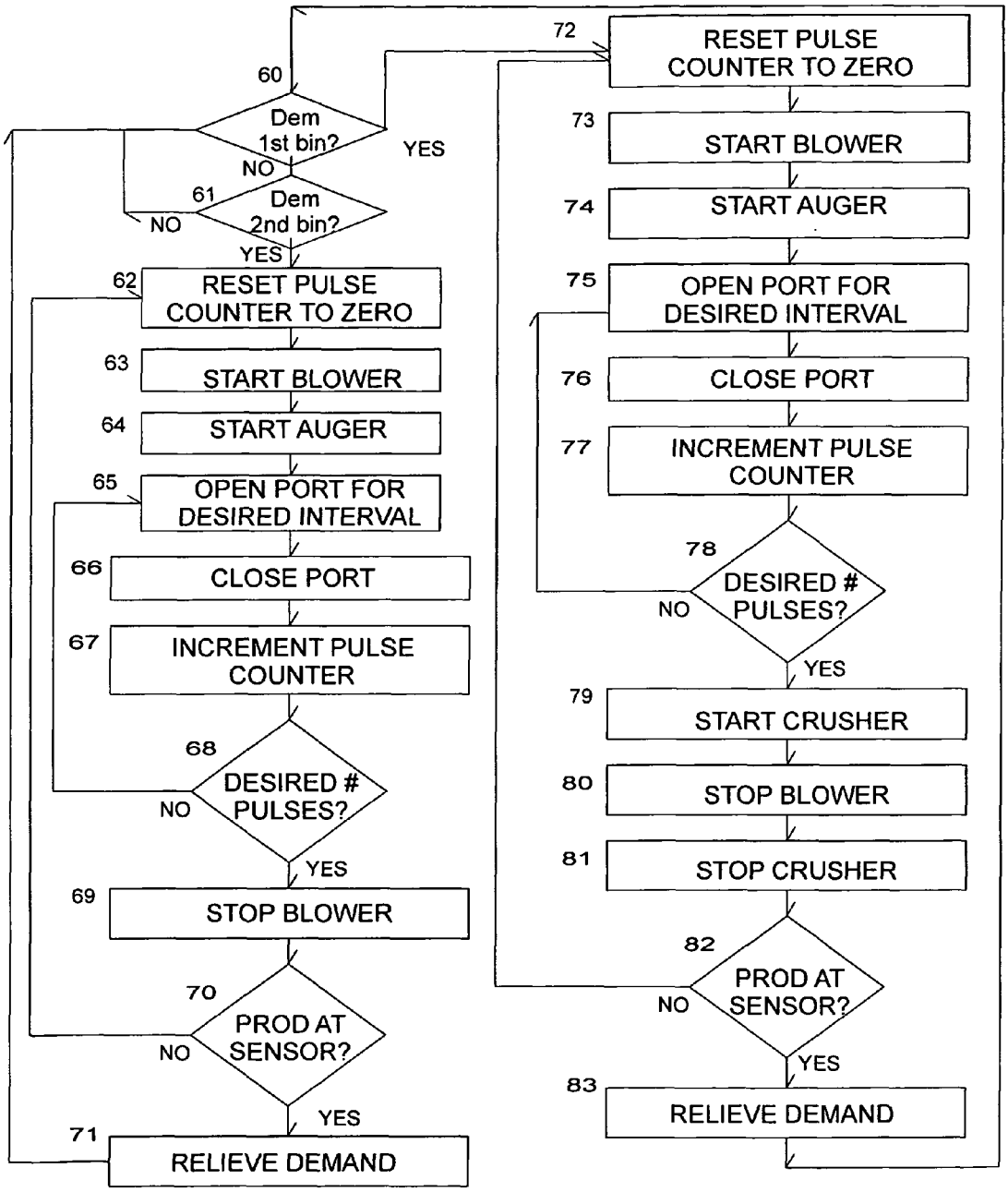
FIG. 7*b* provides a method flowchart for utilizing the ice supply system according to the extension of the second embodiment.

As shown in the method flowchart of FIG. 7*b*, the method of use commences with step 60, wherein the controller 227 determines if demand exists in the first bin 253. If demand exists in step 60, the controller 227 moves to step 72 to reset the pulse counter to zero. Next, the controller 227 starts the blower 111, step 73. In step 74, the controller 227 starts the auger to agitate the product in the bin. In step 75, the controller 227 opens the port to allow product to move through the port. After a predetermined interval, the controller 227 closes the port, step 76. In step 77, the controller 227 increments the pulse count by 1. In step 78, the controller 227 determines if a predetermined number of pulses have been delivered. If a predetermined number of pulses have not been delivered in step 78, the controller 227 returns to step 75 to send another pulse. If a desired number of pulses have been delivered in step 78, the controller 227 moves to step 79, and starts the product engagement device 140. Next, the controller 227 stops the blower 111, step 80. In step 81, the controller 227 stops the product engagement device 140, and moves to step 82 to determine if the product dispensed has reached the level of the sensors 148*a*-148*b*. If the product level has not reached the elevation of the sensors in step 82, the controller 227 returns to step 72 to send more product. If the product level has reached the sensor 148*a*-*b* elevation in step 82, the controller 227 moves to step 83, wherein the controller 227 relieves the demand and returns to step 60.

If the controller 227 determines that there is no demand present in step 60, the controller 227 moves to step 61 to determine if demand is present at the second bin 254. If no demand is present in step 61, the controller 227 returns to step 60. If demand is present in the second bin 254, the controller 227 moves to step 62, and resets the pulse counter to zero. In step 63, the controller 227 starts the blower 111. Next, in step 64, the controller 227 starts the auger. In step 65, the controller 227 opens the port, thereby allowing access through the port. After a predetermine interval, the controller 227 closes the port, step 66. In step 67, the controller 227 increments the pulse counter by one. In step 68, the controller 227 determines if the desired number of pulses has been delivered. If the desired number of pulses has not been delivered in step 68, the controller 227 returns to step 65 to deliver an additional pulse. If a desired number of pulses have been delivered in step 68, the controller 227 moves to step 69 and stops the blower 111. In step 70, the controller 227 determines if the dispensed product level has reached the elevation of the sensors 230*a*-*b*. If the level of dispensed product in step 70 has not reached the sensor level 230*a*-*b*, the controller 227 returns to step 62 to deliver more product. If the level of dispensed product in step 70 has reached the sensor 230*a*-*b* level, the controller 227 moves to step 71 and relieves the demand. The controller 227 then returns to step 60.

Figure 8A:
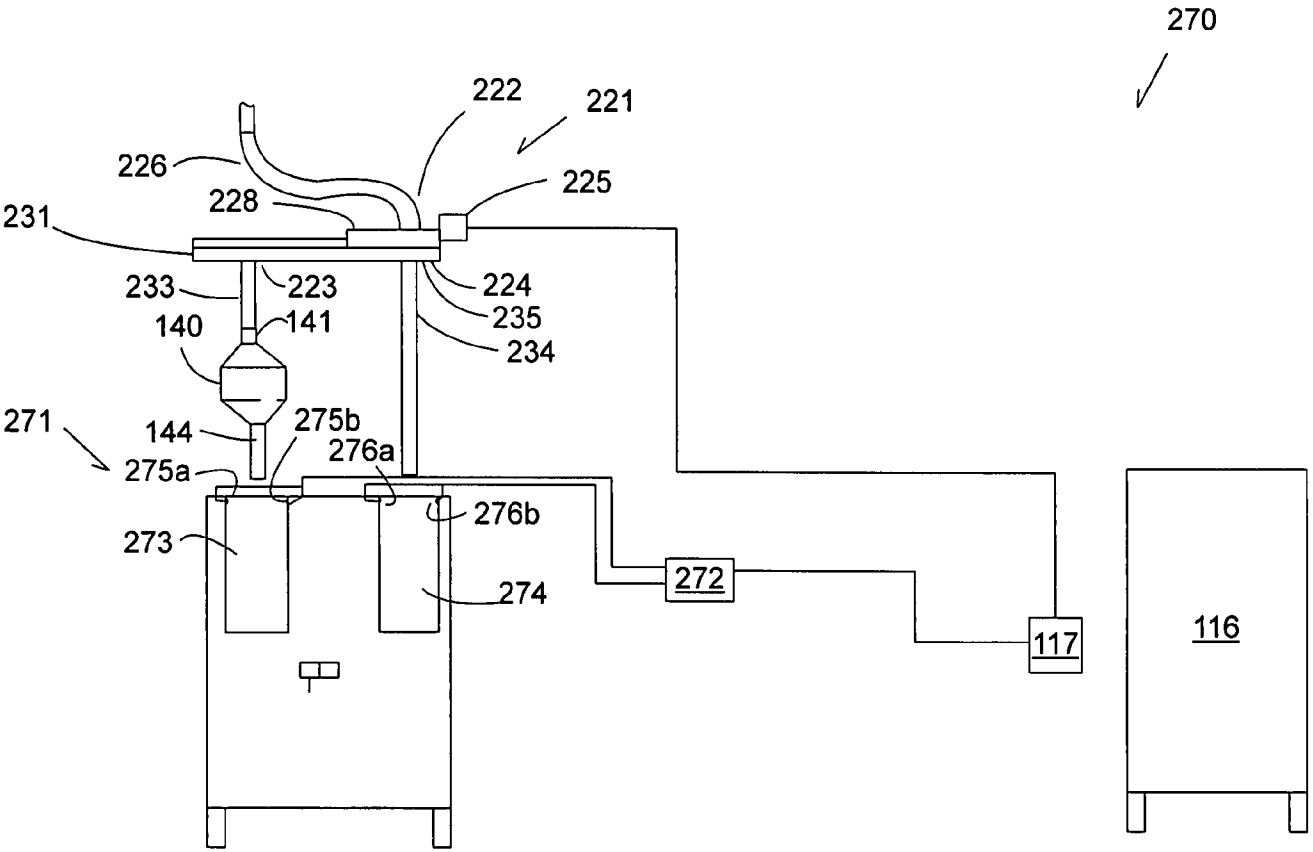
FIG. 8*a* provides a plan view of an ice supply system in combination with a beverage dispenser according to an alternative embodiment.

In an alternative embodiment, an ice supply system 270 includes the ice transport system and a beverage dispenser 271. As shown in FIG. 8*a*, the beverage dispenser 271 includes a dispenser controller 272, a first bin 273 having a first sensor pair 275*a*-*b*, and a second bin 274 having a second sensor pair 276*a-b*. The sensor pairs 275 and 276 of this embodiment are identical in form and function to the sensors 148*a-b* and 230*a-b* of the previous embodiments. In this particular example, the sensor pair 275*a* and 275*b* are disposed at an upper end of the first bin 273, and the sensor pair 276*a* and 276*b* are disposed at an upper end of the second bin 274. The sensor pairs 275 and 276 are in electrical communication with the dispenser controller 272, and monitor the levels of the first bin 273 and the second bin 274, respectively. The dispenser controller 272 is also in electrical communication with the controller 117 of the ice transport system 100.

In this alternate embodiment, the ice transport system does not include sensors at the outlets of the discharge conduit 144 and the secondary path conduit, because the controller 117 is not monitoring the levels of the first and second bins 273 and 274. Accordingly, the ice transport system is operating in a slave mode, whereby the dispenser controller 272 receives inputs from the sensors 275-276, determines if product is required, and delivers demand signal to the controller 117, for ice replenishment.

Figure 8B:
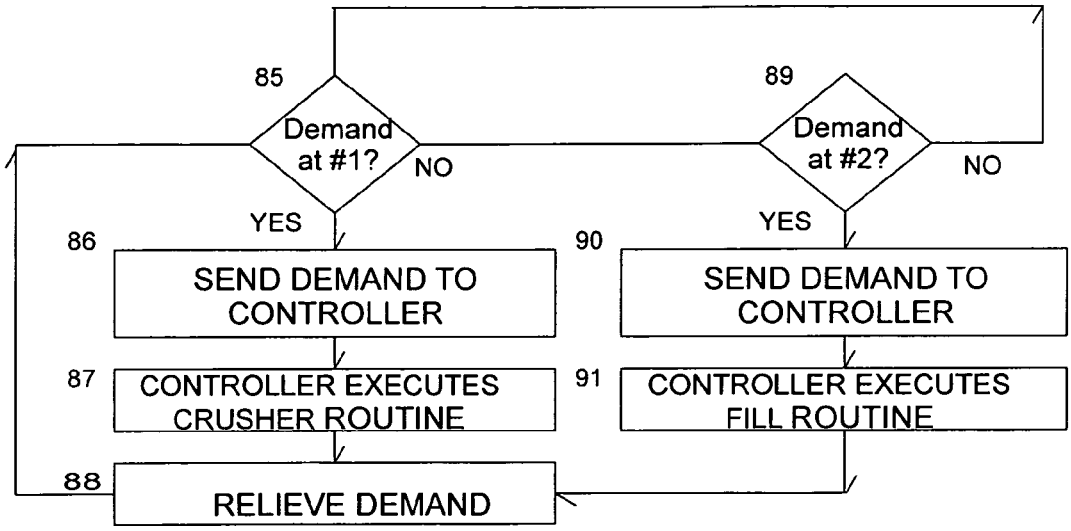
FIG. 8*b* provides a method flowchart for utilizing the ice supply system in combination with the beverage dispenser according to the alternative embodiment.

As shown in FIG. 8*b*, the process of the ice filling routine being in a "slave" mode commences with step 85, wherein the dispenser controller 272 determines if a demand exists in the first bin 273. If a demand does exist in step 85, the dispenser controller 272 sends a demand signal to the controller 117 of the ice transport system, step 86. Next, the controller 117 executes an engaged product fill routine, thereby filling the first bin 273, step 87. In step 88, the controller 117 relieves the demand and returns to step 85. If a demand does not exist in step 85, the dispenser controller 272 moves to step 89 to determine if demand is present. If demand is not present in step 89, the controller 272 returns to step 85. If demand is present in step 89, the controller 272 sends a demand signal to the controller 117. In step 91, the controller 117 executes a fill routine for non-engaged product, otherwise known as "uncrushed." After filling, the controller 272 moves to step 88 to relieve the demand, and then returns to step 85 to restart the process.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. An ice supply system, comprising:

a product generator including a product outlet for delivering product;

an ice transport system, comprising at least one product path in fluid communication with the product outlet, whereby a controller selectively delivers a product from the product generator to an accumulator disposed within the at least one product path, and further wherein the product is delivered through an outlet of the accumulator;

a diverter, comprising:

a first position defining a primary flowpath, wherein the primary flowpath comprises a diverter inlet coupled with the outlet of the accumulator and a primary path outlet, and a second position defining a secondary flowpath, wherein the secondary flowpath comprises the diverter inlet and a secondary path outlet;

a product engagement device, comprising:

a housing, comprising:

an inlet for receiving the product from the primary path outlet, and a discharge tube including an outlet, wherein the outlet discharges an engaged product for use, and at least one product engagement jaw disposed within the housing, wherein the at least one product engagement jaw is coupled to a driver in electrical communication with the controller of the ice transport system;

wherein the controller is in electrical communication with the diverter to control a current position of the diverter, whereby, when the controller selectively delivers the product through the primary flowpath and to the product engagement device, the controller powers the driver to drive the at least one product engagement jaw such that the product engagement device discharges the engaged product through the outlet of the discharge tube for use, further whereby, when the controller selectively delivers the product through the secondary flowpath, a second discharge tube coupled with the secondary path outlet discharges the product through an outlet of the second discharge tube in a non-engaged form.

2. The ice supply system according to claim 1, further comprising:

at least one sensor in electrical communication with the controller, whereby the controller discerns the presence of the product at an elevation of the at least one sensor.

3. The ice supply system according to claim 2, wherein the at least one sensor is an optical pair.

4. The ice supply system according to claim 1, wherein the at least one product engagement jaw is a rotating drum having at least one tooth.

5. The ice supply system according to claim 2, wherein the at least one sensor is in communication with the flow of product through the discharge tube.

6. The ice supply system according to claim 1, further comprising:

a product receptacle disposed beneath the discharge outlet, wherein the product receptacle receives the engaged product for use.

7. The ice supply system according to claim 6, wherein the product receptacle includes an elevation adjustment.

8. The ice supply system according to claim 6, wherein the product receptacle is a counter top in a store.

9. The ice supply system according to claim 6, wherein the product receptacle is mobile.

10. The ice supply system according to claim 9, wherein the product receptacle includes an elevation adjustment.

11. The ice supply system according to claim 2, wherein the at least one sensor is in communication with the flow of product through the primary flowpath of the diverter and the discharge tube of the product engagement device.

12. The ice supply system according to claim 1, further comprising at least one sensor in communication with a product stream passing through the secondary flowpath of the diverter to ascertain the presence of the non-engaged product, wherein the at least one sensor is in electrical communication with the controller to determine the presence of the non-engaged product.

13. The ice supply system according to claim 11, wherein the at least one sensor is disposed at the outlet of the discharge tube of the product engagement device.

14. The ice supply system according to claim 12, wherein the at least one sensor is disposed at the outlet of the second discharge tube.

15. The ice supply system according to claim 1, further comprising at least one product receptacle disposed beneath at least one discharge outlet to catch the discharged product.

16. The ice supply system according to claim 15, wherein the product receptacle comprises an elevation adjustment to create a product pile.

17. The ice supply system according to claim 15, wherein the product receptacle is mobile.

18. The ice supply system according to claim 1, wherein the ice supply system delivers product to a beverage dispenser, and further wherein the controller monitors at least one product level in the beverage dispenser.

19. The ice supply system according to claim 1, wherein the non-engaged product is ice, and further wherein the engaged product is crushed ice.

* * * * *